US006663429B1

(12) United States Patent
Korsunsky et al.

(10) Patent No.: US 6,663,429 B1
(45) Date of Patent: Dec. 16, 2003

(54) METHOD FOR MANUFACTURING HIGH DENSITY ELECTRICAL CONNECTOR ASSEMBLY

(75) Inventors: Iosif R. Korsunsky, Harrisburg, PA (US); Timothy B. Billman, Dover, PA (US); Eric D. Juntwait, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/231,646

(22) Filed: Aug. 29, 2002

(51) Int. Cl.[7] ..... H01R 13/648
(52) U.S. Cl. ..... 439/608; 439/108; 439/701
(58) Field of Search ..... 439/607–610, 439/701, 79, 108

(56) References Cited

U.S. PATENT DOCUMENTS 5,429,520 A * 7/1995 Morlion et al. ..... 439/108
5,679,006 A * 10/1997 Madelaine ..... 439/63
5,980,321 A 11/1999 Cohen et al.
6,152,747 A 11/2000 McNamara
6,168,469 B1 * 1/2001 Lu ..... 439/608
6,267,604 B1 7/2001 Mickievicz et al.
6,293,827 B1 9/2001 Stokoe
6,299,484 B2 10/2001 Van Woensel
6,375,508 B1 * 4/2002 Pickles et al. ..... 439/608
6,520,803 B1 * 2/2003 Dunn ..... 439/608

* cited by examiner

*Primary Examiner*—Tho D. Ta
*Assistant Examiner*—James R. Harvey
(74) *Attorney, Agent, or Firm*—Wei Te Chung

(57) ABSTRACT

A method for manufacturing an electrical connector assembly (100) comprises the steps of: (a) providing a plurality of first wafers (21) each having a first block (25) and a second block (26) disposed on opposite surfaces; (b) inserting terminals (23) into corresponding first wafers and inserting a plurality of grounding buses (24) between every two adjacent first wafers to defines a first spacer (20), each grounding bus including a body portion and a contacting legs (242) on the surfaces of corresponding first spacer; (c) inserting a plurality of circuit boards (30) into slots (27) between the first wafers, in which the circuit boards electrically engage the grounding buses; (d) bringing the first spacer and the circuit boards into a housing (10) to form a receptacle (1); (e) repeating the steps (a) to (d) to form a second spacer (90) having identical structure with the first spacer; and (f) inserting the second spacer into a second housing (82) to form a header (8), inserting the header into the receptacle to electrically connect each other thereby forming the electrical connector assembly.

1 Claim, 20 Drawing Sheets

METHOD FOR MANUFACTURING HIGH DENSITY ELECTRICAL CONNECTOR ASSEMBLY

CROSS-REFERENCE TO RELATED APPLICATIONS

This patent application is a Application of patent application Ser. No. 10/192,048, entitled "HIGH DENSITY ELECTRICAL CONNECTOR ASSEMBLY" and filed on Jul. 9, 2002, and Ser. No. 10/162,724, entitled "HIGH DENSITY ELECTRICAL CONNECTOR WITH LEAD-IN DEVICE" and filed on Jun. 4, 2002, both invented by Timothy Brain Billman et al., assigned to the same assignee.

BACKGROUND OF THE INVENTION

1. Field of the Invention

The present invention relates to a method for manufacturing an electrical connector assembly, and in particular to a method for manufacturing a high density electrical connector assembly which interconnects a daughter board to a backplane.

2. Description of Related Art

With the development of communication and computer technology, high density electrical connectors with conductive elements in a matrix arrangement are desired to construct a large number of signal transmitting paths between two electronic devices. Such high density electrical connectors are widely used in internal connecting systems of severs, routers and the like devices requiring high speed data processing and communication.

Please refer to U.S. Pat. Nos. 5,980,321, 6,152,747, 6,293,827 and 6,267,604, each of which discloses an electrical connector assembly for establishing a connection between a daughter board and a backplane. The connector assembly comprises two mating connector halves, i.e., a header connector connecting with a backplane and a receptacle connector connecting with a daughter card. The backplane and the daughter card are positioned in parallel or perpendicularity to each other. Such electrical connector assembly can be further refereed to Berg Product Catalog published on January 1998 by Berg Electronics, and the website of Teradyne, Inc., at the following Internet address: http://www.teradyne.com/prods/tcs/products/hpi/vhdm/modoconfig.html. Each connector half of the connector assembly comprises an overmolded carrier made of dielectric material and multiple rows and columns of contacts. Each column of the contacts is provided as a separate module. Multiple modules are installed in the insulating carrier to form a complete connector. Generally, all of the modules are substantially identical. However, when it is desired to have different types of modules in the connector in order to meet different requirements of signal transmission, a problem is raised that additional tooling and handling are required for the different types of the modules, thereby increasing manufacturing cost.

It is thus desirable to have a method which can more efficiently manufacture an electrical connector assembly.

SUMMARY OF THE INVENTION

Accordingly, an object of the present invention is to provide a method for manufacturing an electrical connector assembly interconnecting a daughter board and a backplane, wherein the connector assembly has contacts arranged in a matrix manner and mounted in a plurality of contact modules.

Another object of the present invention is to provide a low-cost method for manufacturing an electrical connector assembly.

In order to achieve the objects set forth, a method for manufacturing an electrical connector assembly in accordance with the present invention comprises the steps of: (a) providing a plurality of first wafers each having a first surface and a second surface opposite the first surface, a plurality of recesses being defined in the first surface, a plurality of first blocks and second blocks projecting outward from the first and second surfaces, respectively; (b) inserting a plurality of signal terminals into corresponding recesses of the first wafers; (c) assembling the plurality of first wafers together in a line, the first surface of each of the first wafers facing to the second surface of an adjacent first wafer whereby a plurality of slots is formed between every two adjacent first wafers, and the first blocks of each of the first wafers are in line with the second blocks of an adjacent first wafer; (d) attaching a plurality of grounding buses onto the first wafers, each of the ground buses includes a body portion covering the second surface of a corresponding first wafer and contacting legs on the first surface of the corresponding first wafer, whereby a first spacer is formed; (e) inserting a plurality of circuit boards into the slots defined between the first wafers, in which the circuit boards electrically engage with corresponding signal terminals and grounding buses; (f) bringing the circuit boards and the first spacer into a first housing to form a receptacle, said housing having a plurality of channels receiving the circuit boards therein; (g) repeating the steps a) to d) to form a second spacer having a structure the same as the first spacer; and (h) providing a second housing receiving the second spacer therein thereby forming a header, inserting the circuit boards into the header to electrically connect therewith thereby forming the electrical connector assembly.

Other objects, advantages and novel features of the invention will become more apparent from the following detailed description when taken in conjunction with the accompanying drawings.

DETAILED DESCRIPTION OF THE INVENTION

Figure 1:
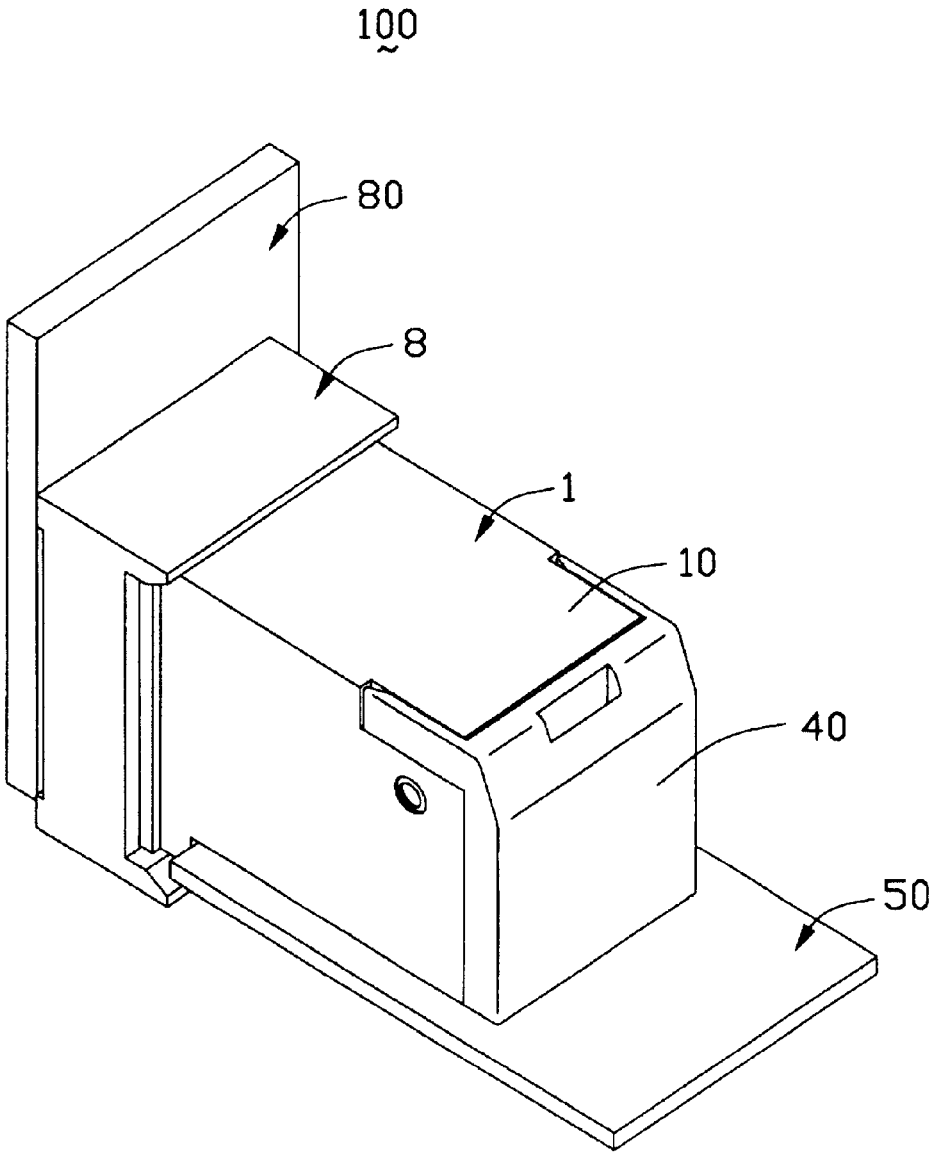
FIG. 1 is a perspective view of a high density electrical connector assembly showing a receptacle and a header in a mated condition.

Referring to FIG. 1, a high density electrical connector assembly 100 in accordance with the present invention comprises a receptacle 1 mounted on a daughter card 50 and a header 8 mounted on a backplane 80.

Referring to FIGS. 2–5, the receptacle 1 comprises a dielectric housing 10, a first spacer 20, a plurality of circuit boards 30 retained between the housing 10 and the first spacer 20, and a fastening device 40 for securing the first spacer 20 to the housing 10. Each of the circuit boards 30 includes a dielectric substrate made of conventional circuit board substrate material, such as FR4, a plurality of conductive signal and grounding traces on one side of the substrate for providing electrical paths through the receptacle 1, and a layer of conductive material coated on an opposite side of the substrate for providing a grounding plane to the substrate.

Figure 6:
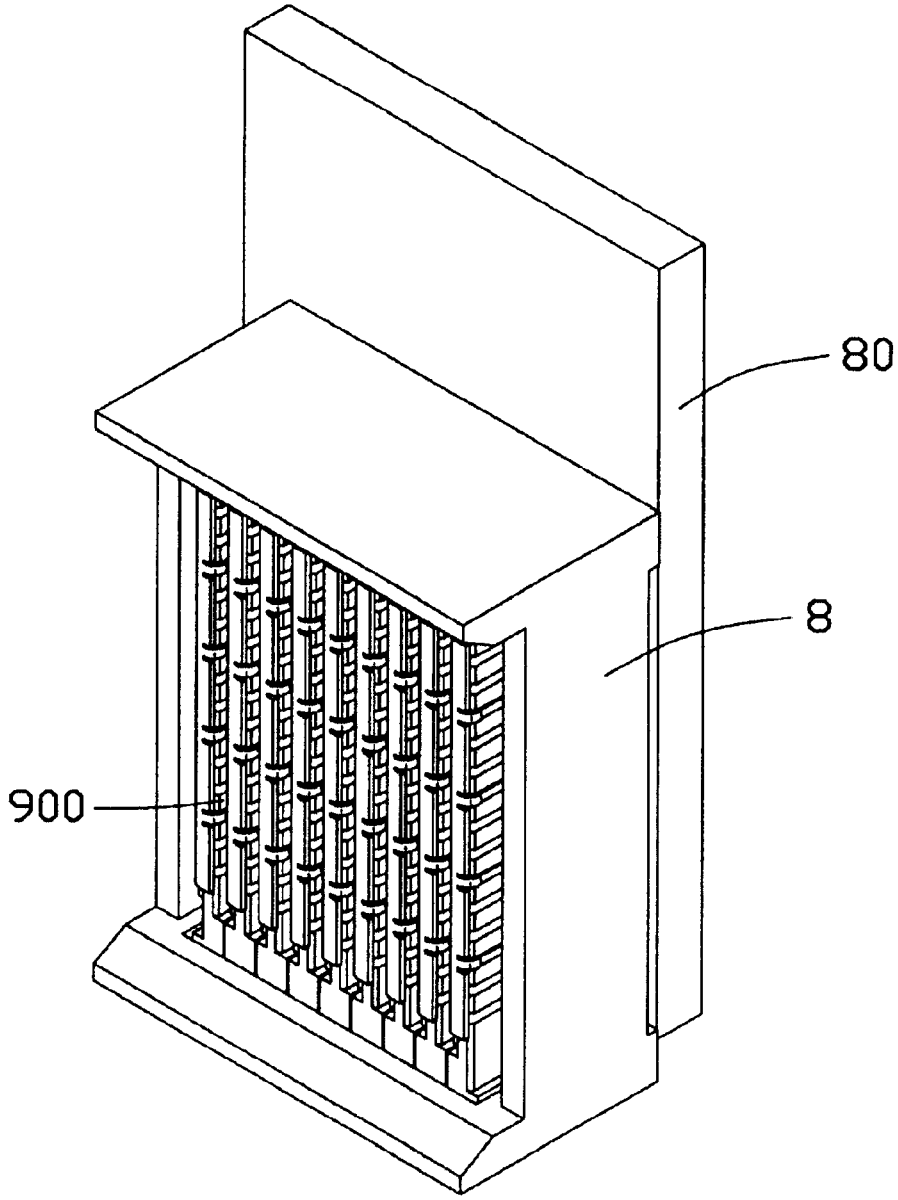
FIG. 6 is a perspective view of the header and a backplane on which the header is mounted in accordance with the present invention.

The dielectric housing 10 is generally in a rectangular shape. The housing 10 defines a front mating port 12 facing the header 8 (shown in FIG. 6) for connecting with a backplane 80 (FIG. 6). The housing 10 defines an opening 13 in a bottom face 101 and a rear face 102 thereof, and a plurality of parallel channels 14 in communication with the opening 13. The channels 14 extend in a longitudinal direction of the housing 10 between the front mating port 12 and the rear face 102. The housing 10 defines a pair of recesses 15 in opposite side faces 104 thereof adjacent to the rear face 102, and a pair of cavities 16 recessed from the recesses 15. An aperture 17 is defined transversely through the opposite side faces 104 of the housing 10 near the rear face 102.

Referring to FIGS. 9–13, the first spacer 20 consists of a plurality of first wafers 21. In the preferred embodiment, each of the first wafers 21 is identical in construction, an exemplary one thereof being shown in FIGS. 9 and 10. Each first wafer 21 includes a dielectric base 22 and a plurality of signal terminals 23 and a grounding bus 24 respectively mounted on opposite sides of the dielectric base 22. The dielectric base 22 has a body portion 220 and front and rear end portions 222, 223. The rear end portion 223 defines a depression 2222 in a rear side thereof.

The body portion 220 of the dielectric base 22 has substantially planar side surfaces 2200, 2202. The body portion 220 forms a plurality of first and second blocks 25, 26 respectively on the side surfaces 2202, 2200. The first and the second blocks 25, 26 are located adjacent to a bottom surface 2204 of the body portion 220 in a staggered manner. Bottom faces of the first and the second blocks 25, 26 are flush with the bottom surface 2204 of the body portion 220 of the dielectric base 22. Each second block 26 includes a pair of ribs 262 and an embossment 264 located between the ribs 262. The side surface 2200 of the body portion 220 of the dielectric base 22 defines a plurality of slots 27 extending through the second blocks 26 to thereby running through a whole height of the body portion 220. The side surface 2200 of the dielectric base 22 also defines a plurality of recesses 28 adjacent to a top edge 224 of the body portion 220 between every two slots 27.

Figure 9:
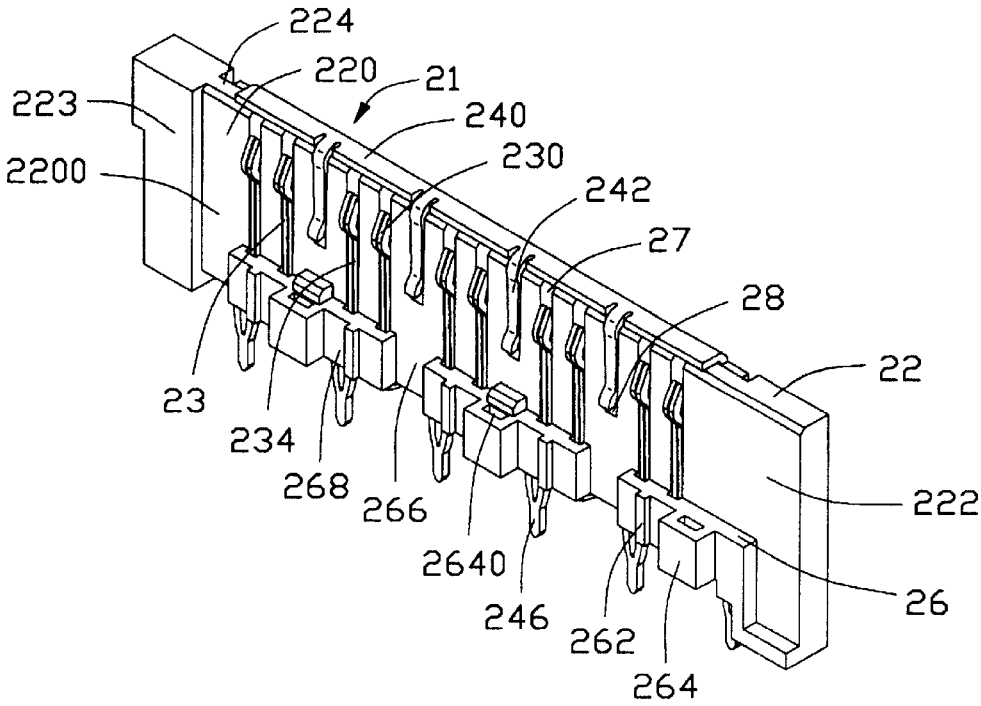
FIG. 9 is an enlarged perspective view of a first wafer of the receptacle shown in FIG. 5.
Figure 10:
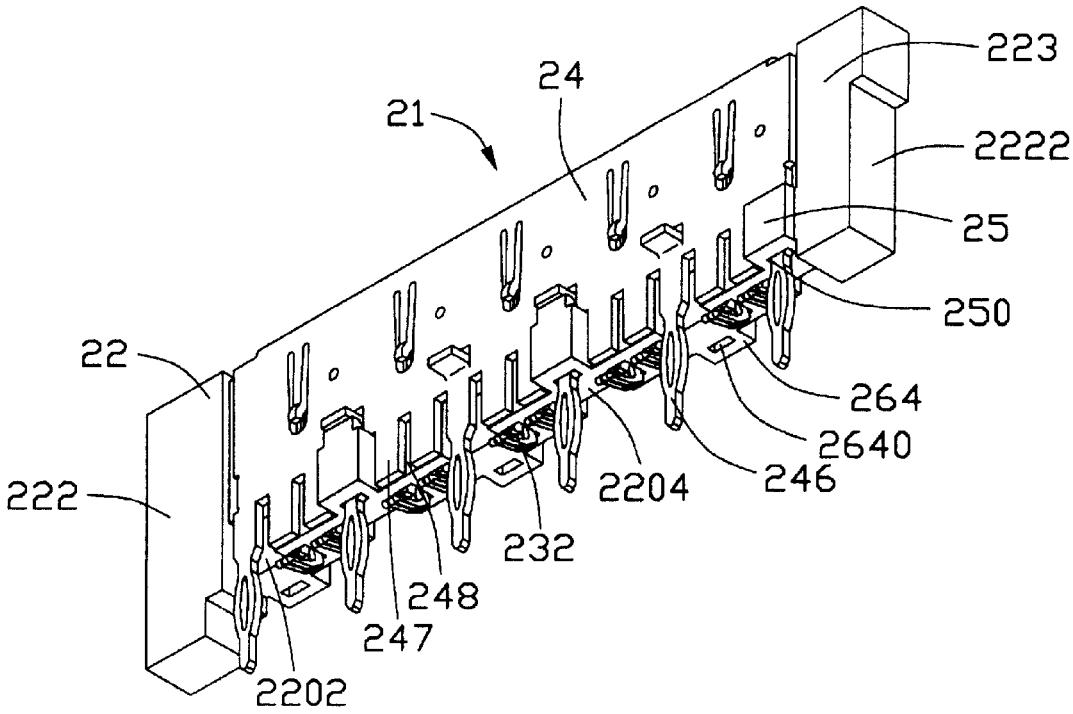
FIG. 10 is a view of the wafer similar to FIG. 9 but taken from a different aspect.
Figure 11:
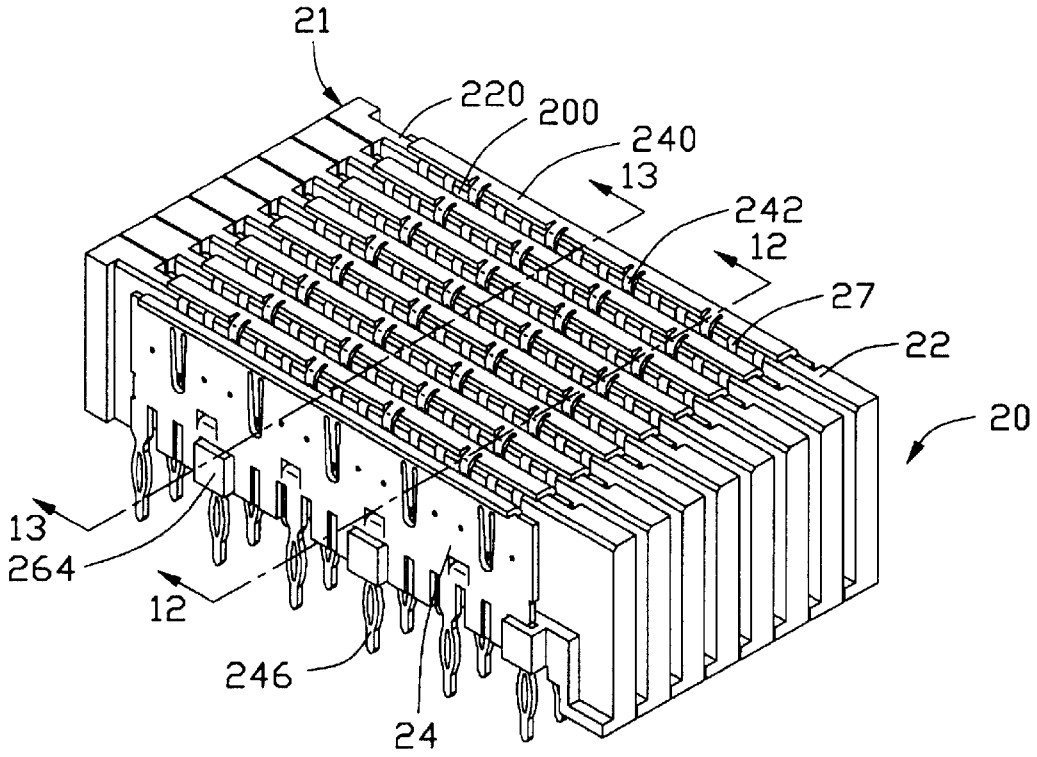
FIG. 11 is a perspective view showing a number of the wafer of FIG. 9 assembled together.

Referring to FIGS. 11–14 in conjunction with FIGS. 9 and 10, the plurality of first wafers 21 is assembled together to form the first spacer 20. A plurality of parallel slots 200 is defined between adjacent first wafers 21 for receiving the circuit boards 30 therein. When assembling, the rear end portions 223 of the first wafers 21 are aligned with each other, and the first blocks 25 of each first wafer 21 have an interferential fit with corresponding recesses 266 defined between the second blocks 26 of an adjacent first wafer 21.

Subsequently, the plurality of signal terminals 23 and the grounding buses 24 are assembled onto the first spacer 20 to thereby make each first wafer 21 with the signal terminals 23 received in the slots 27 in the side surface 2200, and with the grounding bus 24 disposed on the side surface 2202 of the first wafer 21. Each slot 27 receives a pair of signal terminals 23 therein. The signal terminals 23 are stamped from a single piece of metal sheet. Each signal terminal 23 includes a curved contacting portion 230 raised outside of the side surface 2200 of the dielectric base 22 for contacting with the signal traces of an inserted circuit board 30, a bent tail portion 232 extending toward the side surface 2202 of the dielectric base 22, and an intermediate portion 234 interconnecting the contacting portion 230 with the bent tail portion 232. There exists a clearance (not labeled) between the bent tail portion 232 and the bottom surface 2204 of the dielectric base 22.

The grounding bus 24 is formed as a single piece snugly bearing against the side surface 2202 of the corresponding dielectric base 22. The grounding bus 24 has a top flange 240 covering the top edge 224 of the body portion 220, and a plurality of contacting legs 242 depending downwardly from the top flange 240 to be aligned with the recesses 28 of the dielectric base 22. A top end of each contacting leg 242 and the top flange 240 opposite to the contacting legs 242 respectively functions as a lead-in for facilitating insertion of the circuit board 30 into a corresponding slot 200. In addition, the grounding bus 24 has press-fit tails 246 for fittingly engaging with the daughter card 50. The tails 246 have a number which is the same as a total number of the first and the second blocks 25, 26 of the wafer 21. The grounding bus 24 also has several flaps 247 and slots 248 defined between two adjacent press-fit tails 246. The press-fit tails 246 extend beyond the bottom surface 2204 of the dielectric base 22 through apertures 250, 2640 respectively defined in the first blocks 25 of each wafer 21 and the second blocks 26 of an adjacent wafer 21. The flaps 247 of the grounding bus 24 are received in recesses 268 in the second blocks 26 of an adjacent wafer 21. Thus, the flaps 247 are disposed between the signal terminals 23 mounted on the two adjacent first wafers 21 for functioning as a shell near lower ends of the signal terminals 23. The ribs 262 of the second blocks 26 of each wafer 21 are received in some of the slots 248 of an adjacent wafer 21.

Referring back to FIGS. 1–5, each of the circuit boards 30 has a mating portion 300, a mounting portion 302 and a rearward edge 304. After the first spacer 20 is formed, the circuit boards 30 are respectively inserted into the slots 200 formed between the wafers 21. The mounting portion 302 of the circuit board 30 is received in a corresponding slot 200 for engaging with the signal terminals 23 and the grounding bus 24 of the first wafer 21. At the same time, the contacting portions 230 of the signal terminals 23 electrically contact with the signal traces on the circuit board 30, and the contacting legs 242 of the grounding bus 24 electrically contact with the grounding traces on the circuit board 30. The rearward edges 304 of the circuit boards 30 abut against the rear end portions 223 of the dielectric base 22.

The first spacer 20 with the parallel circuit boards 30 received therein is then mounted to the dielectric housing 10 in a back-to-front direction. The first spacer 20 is received in the opening 13 of the housing 10. The channels 14 of the housing 10 guide the mating portions 300 of the circuit boards 30 into the mating port 12 of the housing 10. Finally, the fastening device 40 is attached to the housing 10 thereby fixing the first spacer 20 with the circuit boards 30 to the housing 10. The fastening device 40 includes a rear wall 400 covering the rear face 102 of the housing 10, and a pair of latches 402 forwardly extending from opposite side edges of the rear wall 400. Each latch 402 has a hook 404 at a free end thereof. The latches 402 are received in the recesses 15 of the housing 10 and the hooks 404 are locked in the cavities 16 of the housing 10. The rear wall 400 has a protrusion 406 on an inner face thereof abutting against a top face of the depression 2222 of the spacer 20, whereby the housing 10, the spacer 20, the circuit boards 30 and the fastening device 40 are securely connected together. A cylinder pin 60 is inserted into through holes 32 of the circuit boards 30 through the aperture 17 of the housing 10 for keeping the circuit boards 30 in their original position rather than be pushed back when the receptacle 1 mates with the header connector 8.

Figure 2:
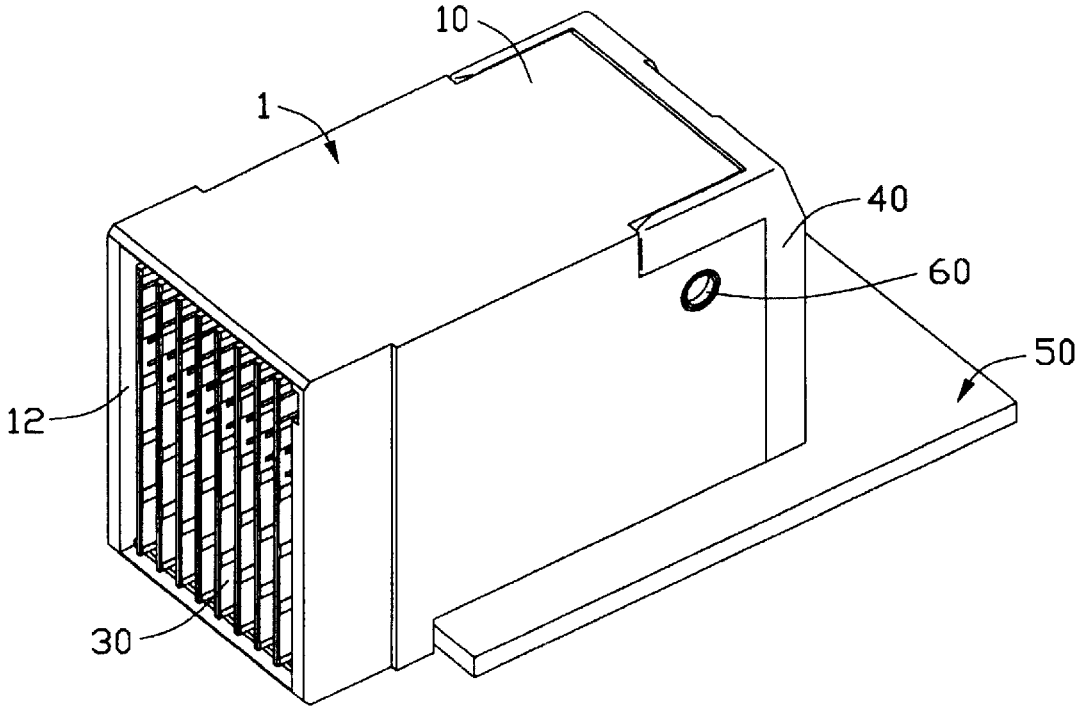
FIG. 2 is a perspective view of the receptacle and a daughter card on which the receptacle is mounted in accordance with the present invention.
Figure 3:
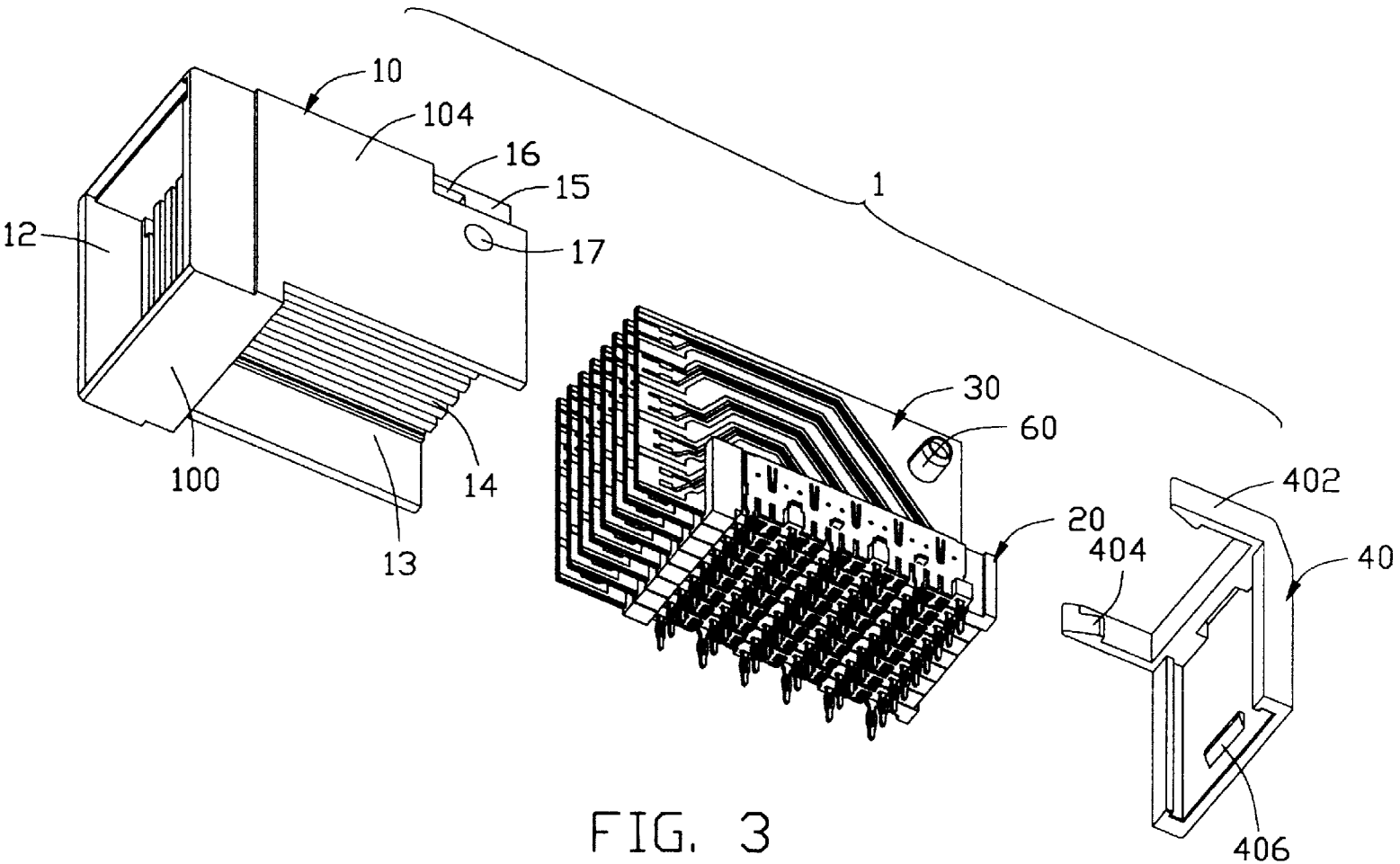
FIG. 3 is a partially exploded view of the receptacle.
Figure 4:
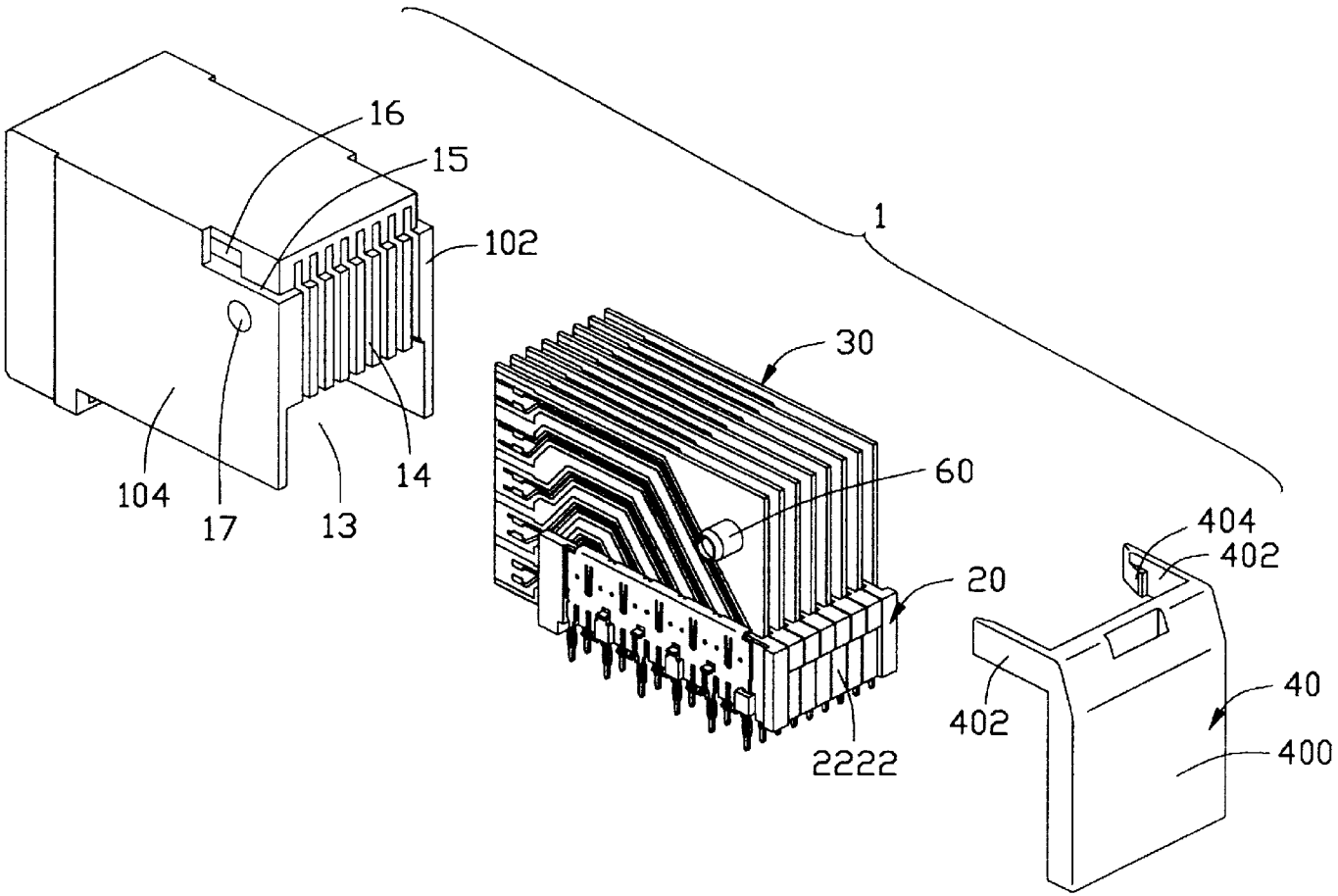
FIG. 4 is a view similar to FIG. 3 but taken from a different perspective.
Figure 5:
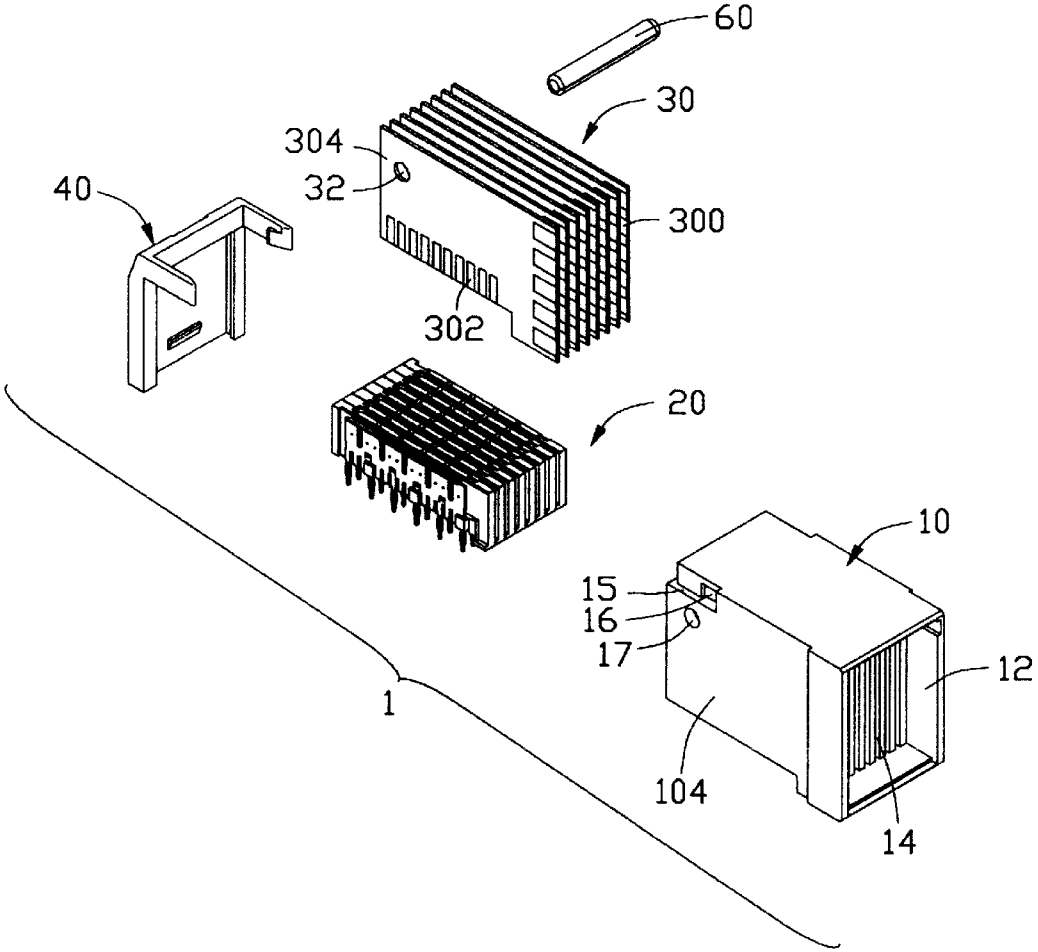
FIG. 5 is an exploded view of the receptacle of the present invention.
Figure 12:
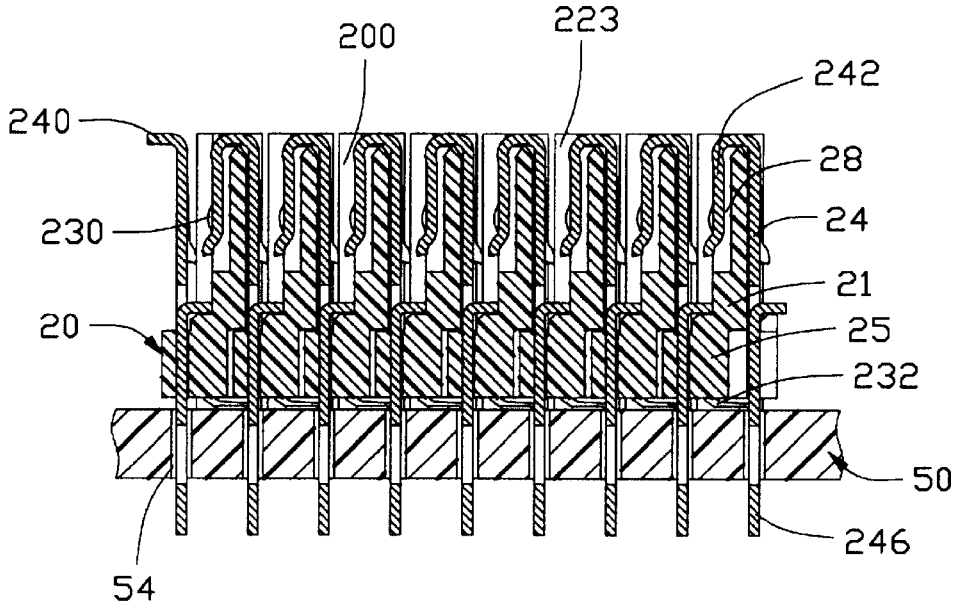
FIG. 12 is a cross-sectional view of the assembled wafers taken along section line 12—12 in FIG. 11 which are mounted on the daughter card.
Figure 13:
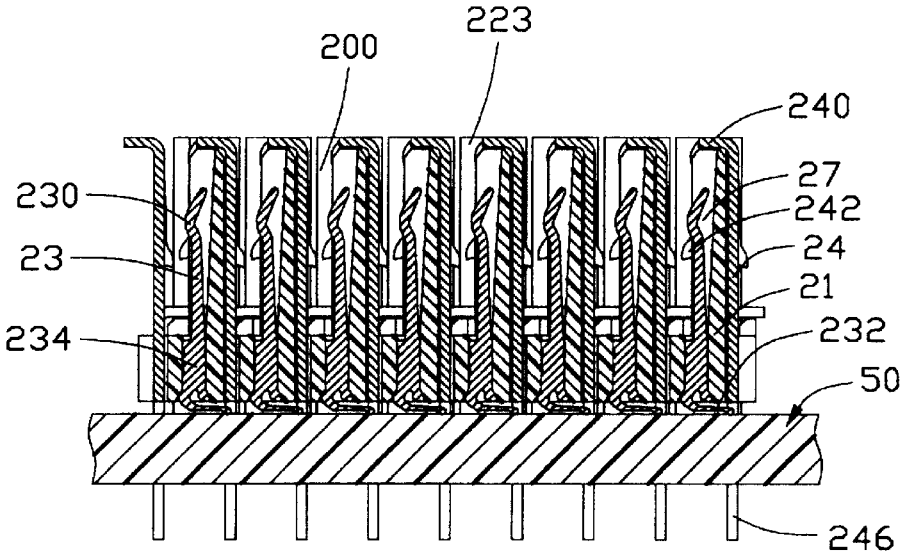
FIG. 13 is a view similar to FIG. 12 but taken along section line 13—13 in FIG. 11.
Figure 14:
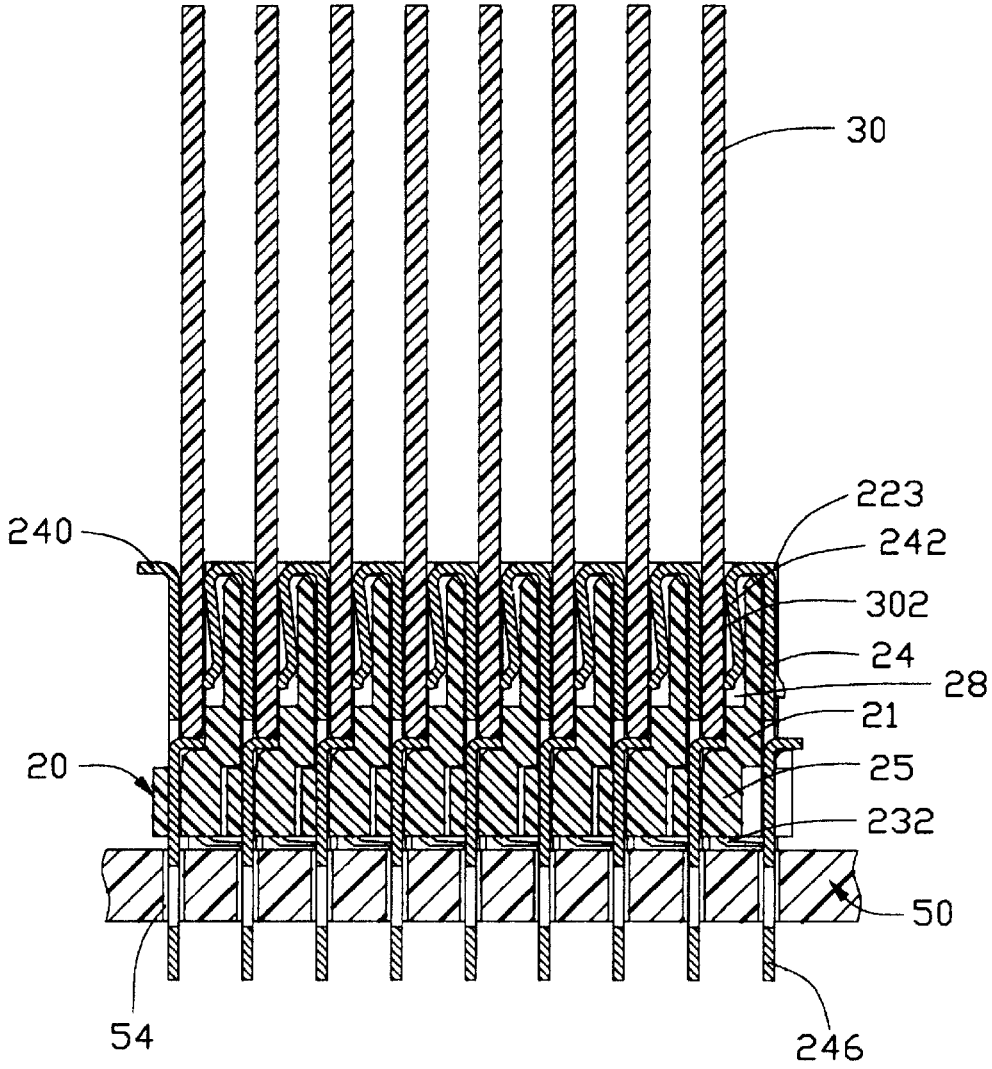
FIG. 14 is a view similar to FIG. 12 with circuit boards being inserted into the wafers.
Figure 15:
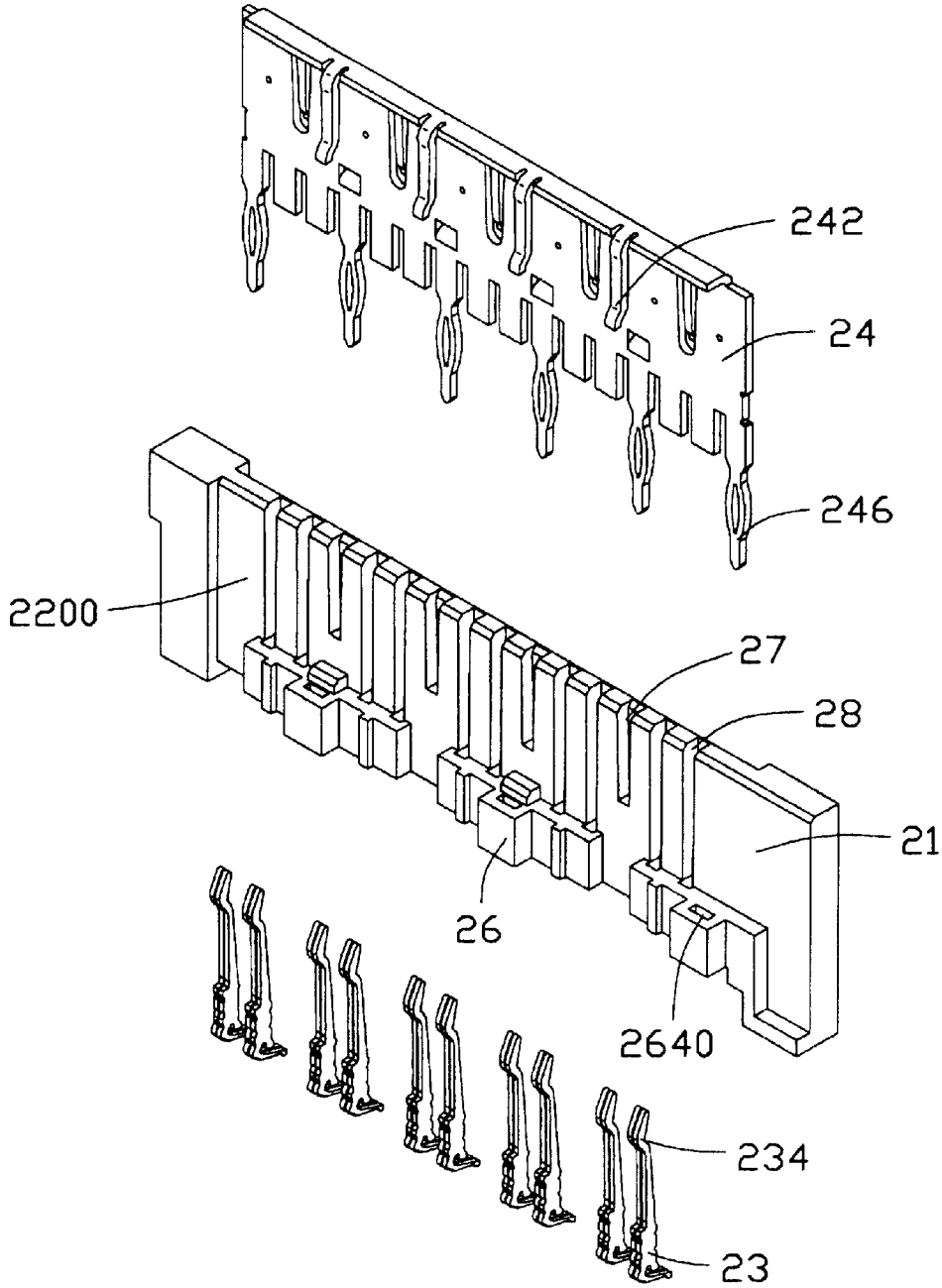
FIG. 15 is an exploded view of FIG. 9.
Figure 16:
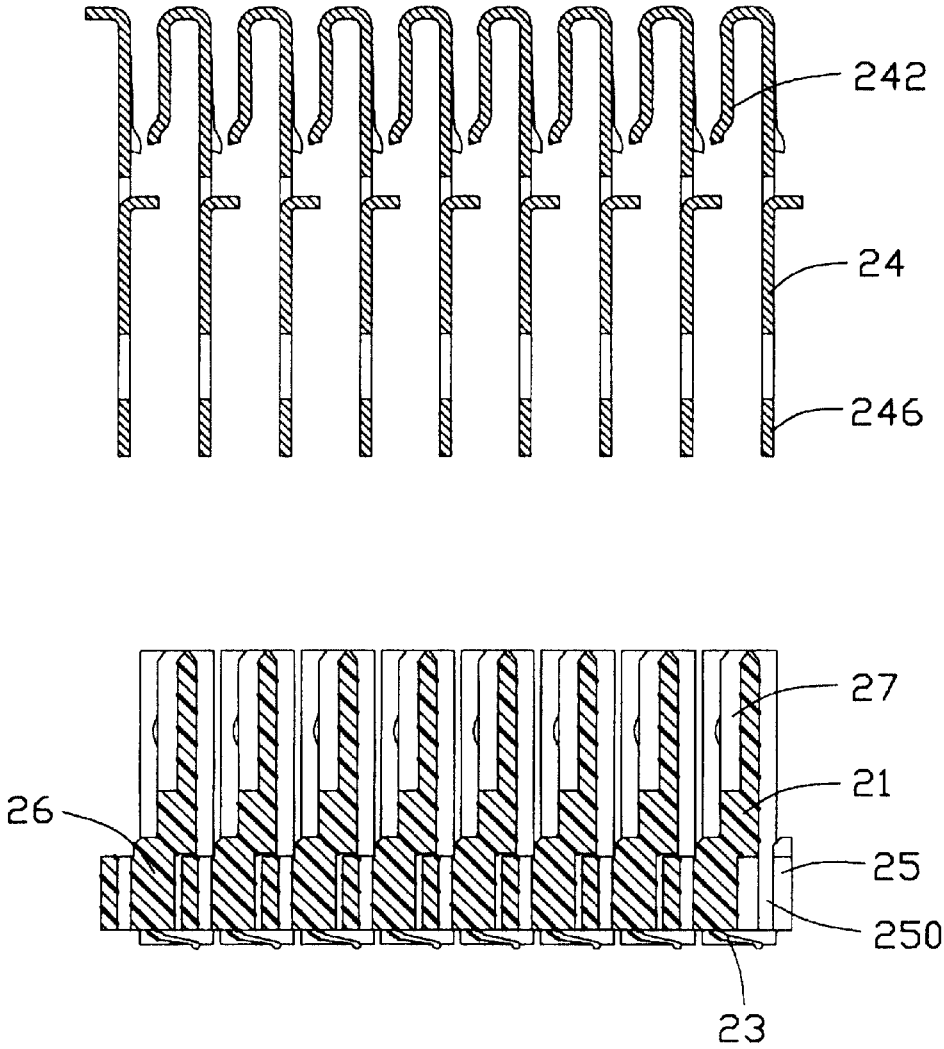
FIG. 16 is a view similar to FIG. 12, with the daughter card being removed therefrom, and grounding buses being exploded away.
Figure 17:
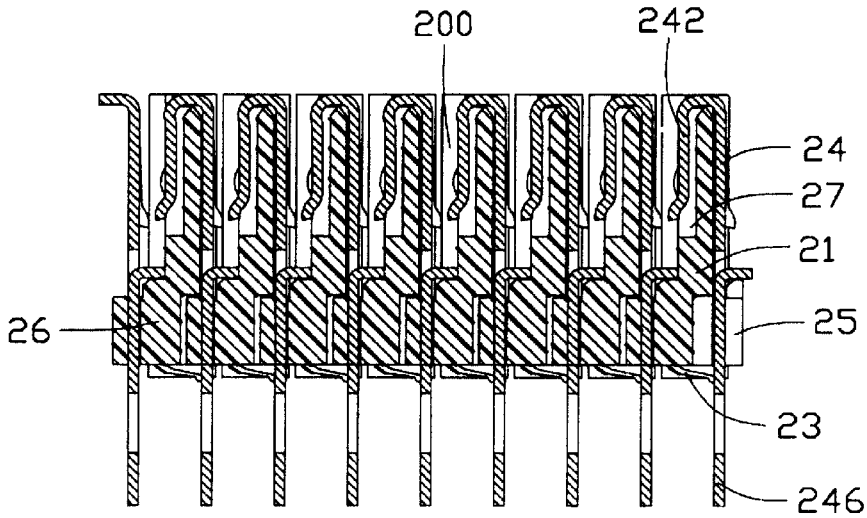
FIG. 17 is a view similar to FIG. 16, with the grounding buses being mounted into first wafers.
Figure 18:
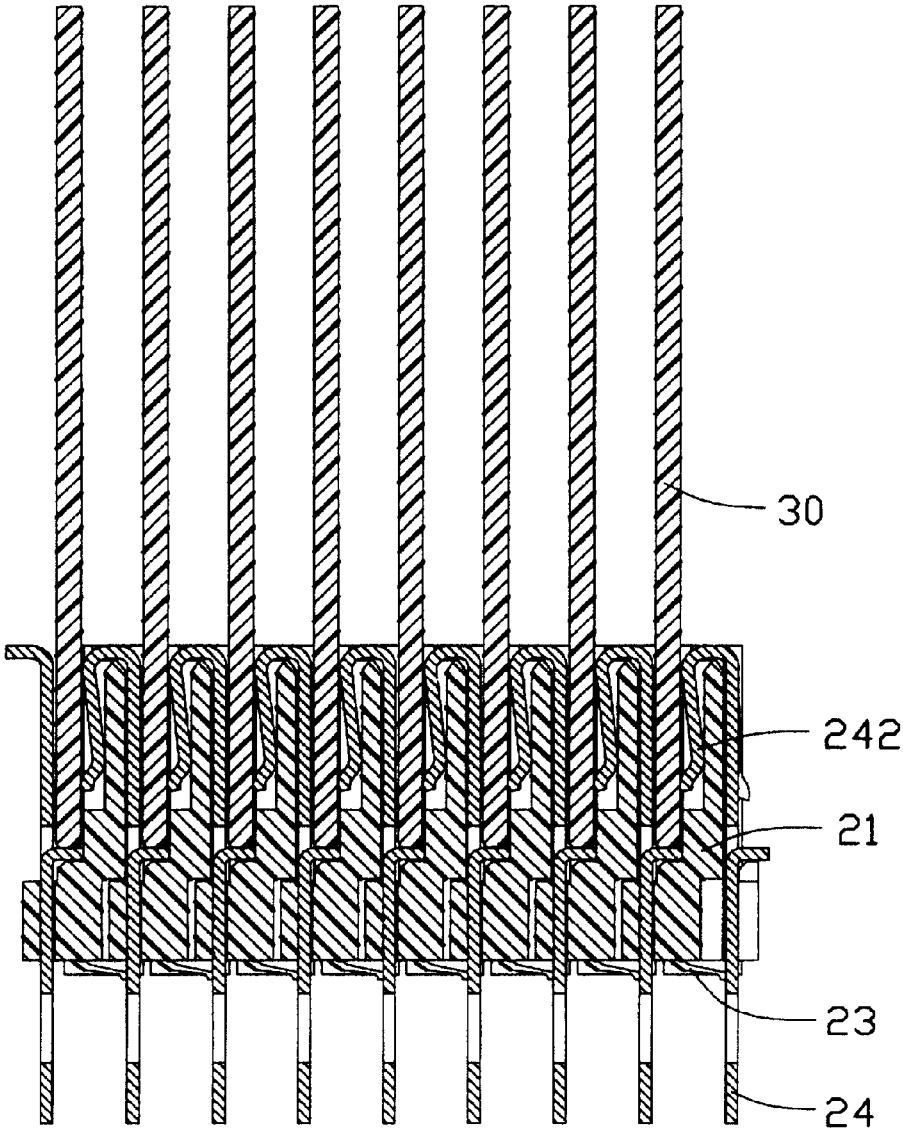
FIG. 18 is a view similar to FIG. 14, with the daughter card being removed.
Figure 19:
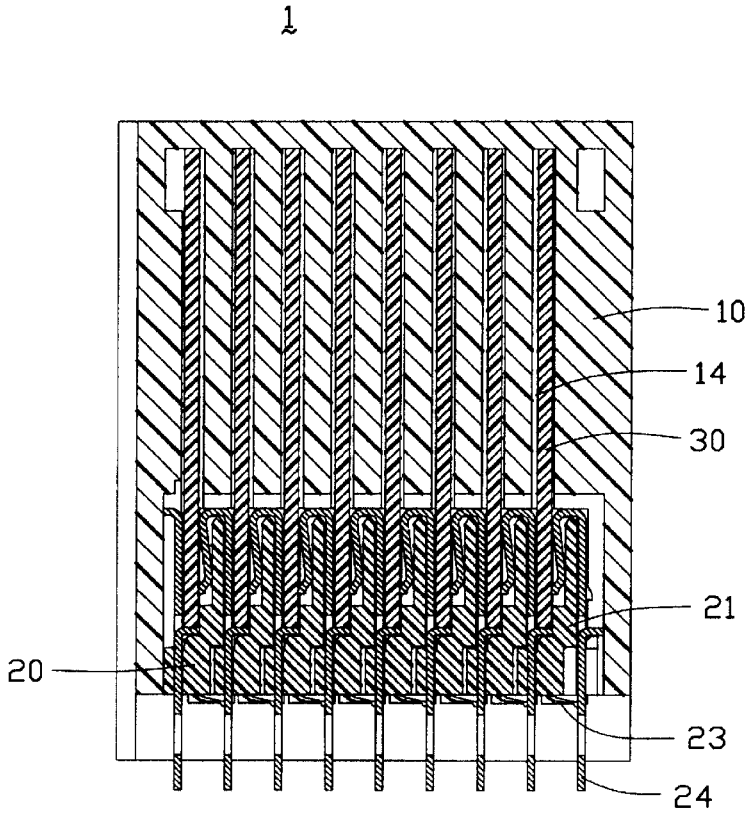
FIG. 19 is a cross-sectional view of the receptacle.
Figure 20:
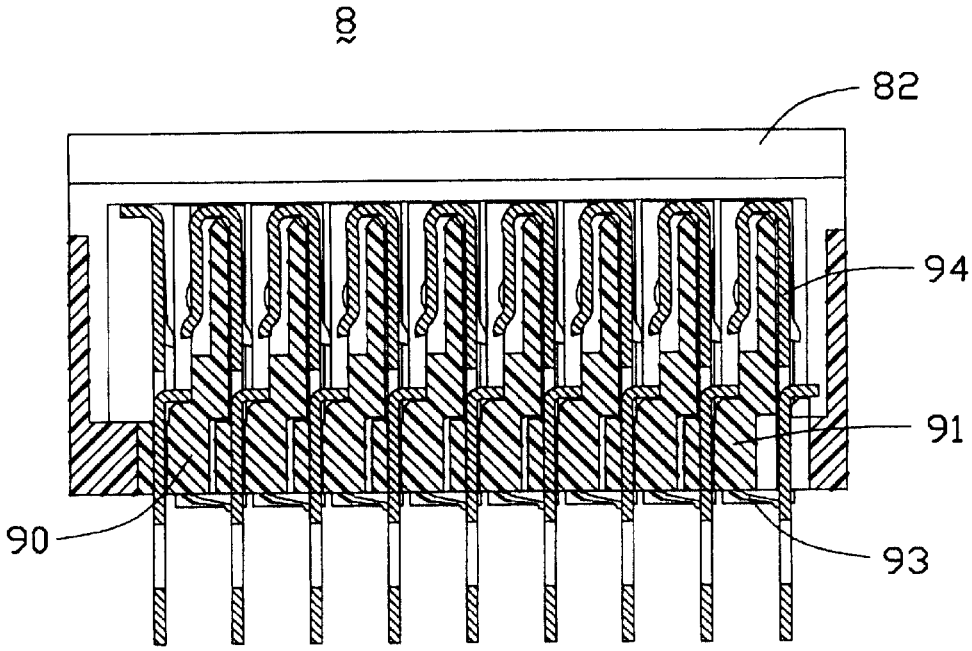
FIG. 20 is a cross-sectional view of the header.

Referring to FIGS. 12–14 in conjunction with FIGS. 1–2, the receptacle 1 is mounted on the daughter card 50 to establish an electrical connection therebetween. The press-fit tails 246 of the grounding bus 24 are interferentially received in plated through holes 54 of the daughter card 50. The press-fit tails 246 of the grounding bus 24 not only establish grounding connection between the receptacle 1 and the daughter card 50, but also sufficiently hold the receptacle 1 against movement relative to the daughter card 50. At the same time, the bent tail portions 232 of the signal terminals 23 are compressibly engaged with signal pads (not shown) on the daughter card 50 for establishing signal connection between the receptacle 1 and the daughter card 50.

It is noted that the receptacle 1 has a plurality of grounding buses 24 disposed between adjacent rows of the signal terminals 23, and each of the circuit boards 30 located between adjacent rows of the signal terminals 23 has the grounding traces and the grounding plane respectively on the opposite sides of the circuit board. Both the grounding buses 24 and the grounding traces and the grounding planes on the circuit boards 30 function as shielding between adjacent rows of the signal terminals 23 to thereby achieve better electrical performance of the receptacle 1. In addition, the circuit boards 30 received in the first spacer 20 are only engaged with the signal terminals 23 and the grounding buses 24 of the wafers 21. Due to elasticity of the signal terminals 23 and the contacting legs 242 of the grounding buses 24, the circuit boards 30 are floatingly received in the first spacer 20 and are electrically connected with the signal terminals 23 and the grounding buses 24. In other words, no additional retention mechanism is needed to fix the mounting portion 302 of the circuit board 30 in the receptacle 1, thereby facilitating assembling the circuit boards 30 into the receptacle 1 and reducing the manufacturing cost.

Figure 7:
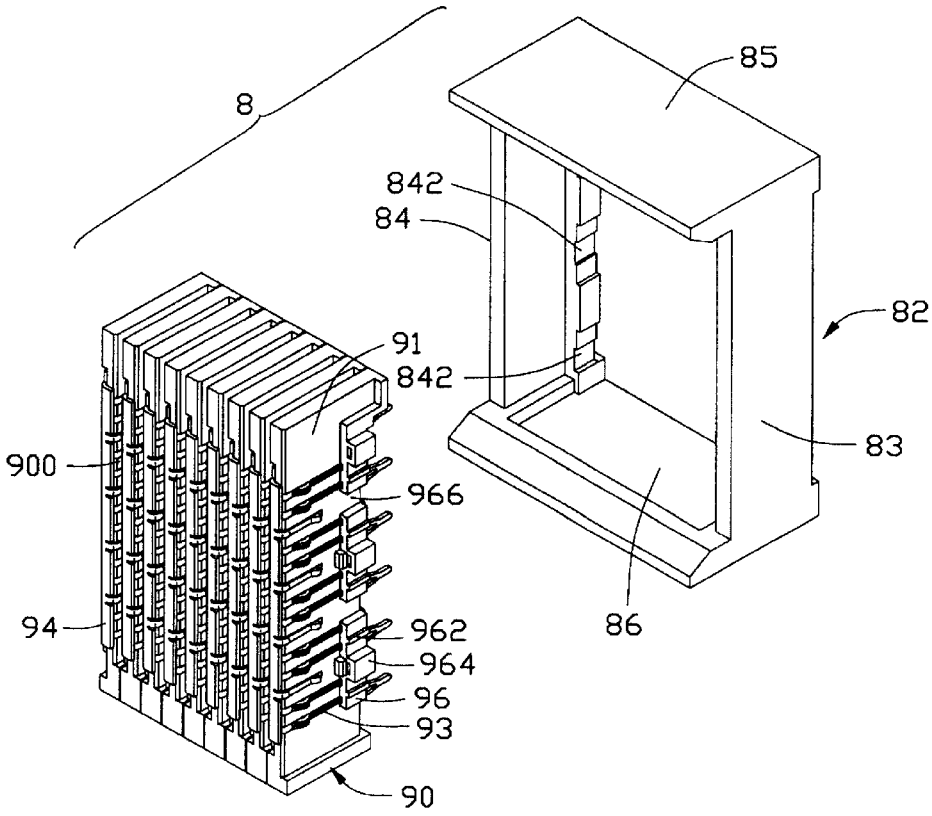
FIG. 7 is a partially exploded view of the header.
Figure 8:
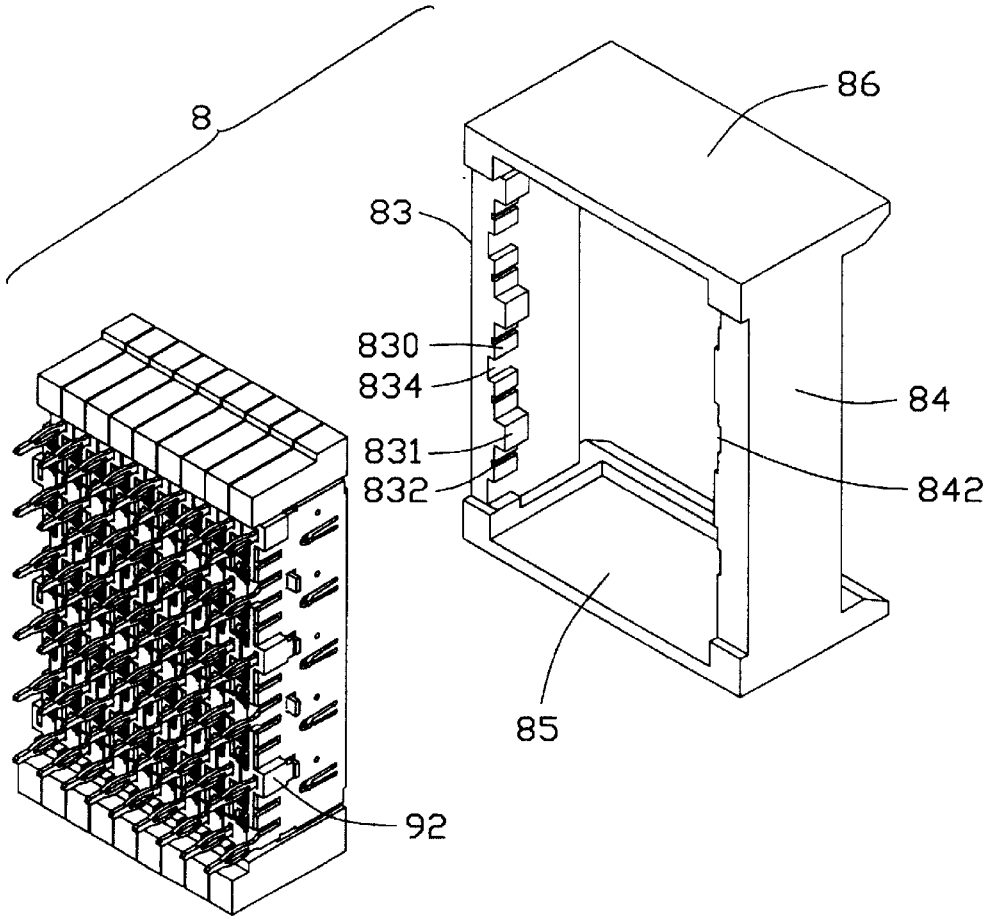
FIG. 8 is a view similar to FIG. 7 but taken from a different perspective.

Referring back to FIGS. 6–8, the header 8 comprises an insulative housing 82 and a second spacer 90. The housing 82 has a first side wall 83, a second side wall 84, an upper wall 85, and a lower wall 86. The first side wall 83 forms a plurality of second blocks 830 on inner surface thereof. Each second block 830 has a pair of grooves 832 and an embossment 831 located between the grooves 832. A recess 834 is defined between each two second blocks 830. A plurality of channels 842 is defined in an inner surface of the second side wall 84.

The second spacer 90 is configurated by a plurality of second wafers 91. The construction of the second wafer 91 of the header 8 is identical with the first wafer 21 of the receptacle 1 shown in FIGS. 9 and 10, thereby reducing the manufacturing cost.

In assembly, the second wafers 91 are assembled together by engaging first blocks 92 formed in a second wafer 91 with second blocks 96 formed on a neighboring second wafer 91 thereby forming the second spacer 90. The second spacer 90 is assembled into the housing 82 with embossments 964 of an outermost second wafer 91 engaging into the recesses 834 of the first wall 83, ribs 962 of the outermost second wafer 91 engaging into the grooves 832 of the first side wall 83, the embossments 831 of the first side wall 83 engaging into recesses 966 of the outermost second wafer 91, and first blocks 92 of the other outermost wafer 91 engaging into the channels 842 of the second side wall 84. The header 8 is mounted on the backplane 80 to establish an electrical connection therebetween.

When the receptacle 1 engages with the header 8, the mating portions 300 of the circuit boards 30 are inserted into slots 900 defined between every two adjacent second wafers 91 of the header 8. The circuit boards 30 received in the second spacer 90 engage with signal terminals 93 and grounding buses 94 of the second spacer 90. Electrical connection is established between the daughter card 50 and the back plane 80 via the interconnection between the receptacle 1 and the header 8.

Referring to FIGS. 15–20, which show steps of manufacturing the electrical connector assembly 100 of the present invention. Because the first wafer 21 is identical with the second wafer 91, so here only the first wafer 21 is shown as the example to construct the connector assembly. Each first wafer 21 includes 10 pairs of the signal terminals inserted into the recesses 28 of the first wafer 21, in which the intermediate portions 234 have an interferential engagement with the second blocks 26. Sequentially, nine first wafers 21 are assembled together to form a framework of the first spacer 20. Then nine grounding buses 24 are attached to the nine wafers 21 with six press-fit tails 246 of each grounding bus 24 being alternately inserted through the apertures 250 and 2640 of the first blocks 25 and second blocks 26 thereby completing the first spacer 20. Eight parallel arranged circuit boards 30 is assembled into the slots 200 defined between every two adjacent wafers 21. Then the housing 10 is assembled with the first spacer 20 and the plurality of circuit boards 30, wherein the channels 14 of the housing 10 guide the mating portions 300 of the circuit boards 30 into the mating port 12 of the housing 10 and the spacer 20 is received in the opening 13. The cylinder pin 60 is brought into the through holes 32 of the circuit boards 30 and the apertures 17 of the housing 10 to fix the housing 10 and spacer 20 and circuit boards 30 together. Finally, the fastening device 40 is fastened to the housing 10 by engaging the hooks 404 of the latches 402 into the cavities 16 of the recesses 15 thereby securing the spacer 20 and the circuit boards 30 in the housing 10. In this way, the whole receptacle 1 completed.

The header 8 is formed by firstly forming the second spacer 90 which has the same construction as the first spacer 20 and is manufactured by the same way. Then the second spacer 20 is assembled with the housing 82 via engagement between the side walls 83, 84 and the second spacer 90.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly adapted for interconnecting two perpendicular electronic elements, comprising:

a receptacle comprising:

a dielectric housing defining a plurality of spaced channels;

a first spacer being assembled to the dielectric housing and comprising a plurality of first wafers assembled together, each of the first wafer comprising a dielectric base and a plurality of signal terminals assembled to the dielectric base for connecting with an electronic element, two first wafers defining a slot; and a plurality of circuit boards being retained in the slots of the first spacer for connecting with the terminals and received in corresponding spaced channels of the dielectric housing; and a header interconnecting corresponding circuit boards of the receptacle to another electronic element;

wherein the header comprises an insulative housing and a second spacer assembled to the insulative housing;

wherein the second spacer comprises a plurality of second wafers assembled together;

wherein each of the first wafers and second wafers further includes a grounding bus mounted on the dielectric base opposite to the signal terminals;

wherein the receptacle further comprises a fastening device for securing the first spacer to the dielectric housing.

* * * * *